US006364023B1

(12) United States Patent
Hiron et al.

(10) Patent No.: US 6,364,023 B1
(45) Date of Patent: Apr. 2, 2002

(54) DOWNHOLE ACTUATOR, AND A FLOW RATE ADJUSTER DEVICE USING SUCH AN ACTUATOR

(75) Inventors: Stéphane Hiron, Igny; Vincent Tourillon, Paris, both of (FR); Christophe Rayssiguier, Houston, TX (US); Gilles Cantin, Verrieres le Buisson (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/518,062

(22) Filed: Mar. 2, 2000

(30) Foreign Application Priority Data

Mar. 5, 1999 (FR) ..... 99 02778

(51) Int. Cl.[7] ..... E21B 34/10
(52) U.S. Cl. ..... 166/373
(58) Field of Search ..... 166/373, 386, 166/66.4, 332.1, 334.1, 334.4

(56) References Cited

U.S. PATENT DOCUMENTS 3,583,481 A * 6/1971 Vernotzy ..... 166/184
4,467,870 A 8/1984 Langham
5,000,215 A * 3/1991 Phillips ..... 137/15
5,101,904 A * 4/1992 Gilbert ..... 166/319
5,299,640 A 4/1994 Streich et al.
5,411,096 A * 5/1995 Akkermen ..... 166/321
5,906,238 A * 5/1999 Carmody et al. ..... 166/53
6,176,254 B1 * 1/2001 Choi ..... 137/334
6,273,194 B1 * 8/2001 Hiron et al. ..... 166/373

* cited by examiner

*Primary Examiner*—William Neuder
(74) *Attorney, Agent, or Firm*—Jeffery Griffin; Jaime Castaño

(57) ABSTRACT

An actuator (14) designed to remain without maintenance down a well for a prolonged period comprises at least one sealing bellows (44) and preferably a compensation bellows (46) between the well fluid and an internal chamber (30) that is full of hydraulic fluid. The bellows (44, 46) serve to make it possible either to omit dynamic elastomer gaskets altogether or at least to protect them from the well environment. The actuator (14) e.g. of the electromechanical type, can serve in particular to control a valve (12) having an opening of adjustable size. Both bellows (44, 46) are advantageously made of stainless steel. They can be mounted end-to-end or they can be quite separate.

25 Claims, 4 Drawing Sheets

DOWNHOLE ACTUATOR, AND A FLOW RATE ADJUSTER DEVICE USING SUCH AN ACTUATOR

TECHNICAL FIELD

The invention relates mainly to an actuator designed to be placed permanently down an oil or gas production well for the purpose of controlling at will the displacement of a moving part therein.

Such an actuator can be used, in particular, for controlling an on/off valve, a variable flow rate valve, or any other device required to remain at the bottom of a well for a prolonged period, e.g. about 5 years, without being subjected to maintenance.

The invention also relates to a flow rate adjuster device fitted with such an actuator.

STATE OF THE ART

Whatever their functions, actuators used at present in downhole installations are generally fitted with dynamic sealing gaskets interposed between the moving portions and the fixed portions of the actuators.

In particular, dynamic sealing gaskets are used both in hydraulic actuators of the piston-and-cylinder type, and in electromechanical actuators of the type incorporating an electric motor and a screw-and-nut system.

When frequent maintenance is possible, elastomer gaskets are used which provide excellent sealing, but which need to be replaced very often.

When it is desired to space out maintenance operations, it is the practice to replace elastomer gaskets with gaskets of other shapes and kinds, such as metal or thermoplastic gaskets. Nevertheless, although the lifetime of such gaskets is greater than that of elastomer gaskets, they still need to be replaced quite often, specifically because of the particularly severe temperature (150° C. to 175° C.) and pressure (1000 bars to 1500 bars) conditions that obtain downhole, because of the corrosive nature of well fluid, and because of the sand and gravel that are often present.

Whatever the kind of gasket used, it is essential to guarantee perfect sealing of the actuator throughout the period that extends between two consecutive maintenance operations. The slightest drop of well fluid penetrating into the actuator could make it inoperative, e.g. by giving rise to a short circuit.

In order to balance the very large pressure present downhole, most actuators operating in that environment contain a hydraulic fluid. A compensation device is then associated with the actuator for the purposes of taking account of variations in pressure and temperature and of continuously balancing the pressures between the well fluid and the hydraulic fluid contained in the actuator. In general, the compensation device is also fitted with dynamic gaskets which give rise to problems analogous to those of the gaskets fitted to the actuator proper.

SUMMARY OF THE INVENTION

A particular object of the invention is to provide an actuator designed to stay downhole without maintenance for a period of time that is much longer than with presently-existing actuators, e.g. about 5 years.

According to the invention, there is provided a downhole actuator comprising control means suitable for displacing a moving member relative to a fixed casing along a longitudinal direction of a well, at least one zone of the casing containing a fluid at substantially the same pressure as the bottom of the well, the actuator further comprising at least one sealing bellows interposed along said direction between the casing and the moving member, the sealing bellows defining at least a portion of said zone.

The use of at least one bellows for sealing the actuator makes it possible either to omit the dynamic sealing gaskets normally used for this purpose, or else to protect them from the downhole atmosphere if they cannot be omitted. Under such circumstances, the gaskets no longer come directly into contact with the fluid present downhole.

Preferably, the actuator comprises a compensation bellows connected to said zone and including a radial wall subjected to the downhole pressure.

The use of a bellows to compensate pressure and temperature variations in the well makes it possible to perform this function while dispensing with all of the dynamic sealing gaskets used in existing compensation devices.

In a first embodiment of the invention, the sealing bellows and the compensation bellows are mounted end-to-end on the same axis. One end of the compensation bellows is then fixed to the casing, and the sealing bellows connects the moving member to the rim of a central opening formed in said radial wall of the compensation bellows.

In a second embodiment of the invention, the sealing bellows and the compensation bellows are separate. The sealing bellows then connects the moving member to the casing and the compensation bellows communicates separately with the above-specified zone of the casing.

In this case, various arrangements are possible depending on the location of the moving member relative to the fixed casing.

Thus, the moving member can be placed beyond one end of the fixed casing. A single sealing bellows then connects the moving member to said end of the casing.

In this case, an end of the compensation bellows remote from the radial wall is fixed either to one end of the casing or else to a portion of the moving member situated outside the casing. In which case, a passage is formed in the casing or in the moving member to connect the above-specified zone to the compensation bellows.

The moving member can also be placed facing an opening formed in the fixed casing. Two sealing bellows then connect the moving member to the casing on respective opposite sides of the opening. In this case, the volume of the zone filled with hydraulic fluid remains substantially constant.

In this case, an end of the compensation bellows remote from the radial wall is fixed to one end of the casing and communicates with said zone.

Advantageously, the sealing bellows and the compensation bellows are made of stainless steel.

In particular, the actuator can be of the electromechanical type. In which case, the control means comprises an electric motor housed in the casing and an intermediate member is rotatably mounted in the casing and suitable for being rotated by the electric motor. The intermediate member then engages the moving member via a screw-and-nut type link.

In general, the casing can either be fixed on the outside of the length of production tubing, parallel thereto, or else it surrounds said length coaxially.

The actuator can also be of the hydraulic type. The control means then comprise a hydraulic piston and cylinder actuated by a pressure source. In which case, the moving member is secured to the piston and is suitable for sliding in sealed manner in the casing which defines at least one control chamber connected to the pressure source. The above-specified zone is then formed outside said chamber, and is separated therefrom by at least one sealing gasket, and is connected to a supply of fluid that is defined at least in part by the compensation bellows.

The invention also provides a downhole flow rate adjuster device including an actuator, a length of production tubing in which at least one opening is formed, and a jacket slidably mounted relative to said length, the actuator having control means suitable for displacing a moving member linked to said jacket relative to a fixed casing linked to said length in a longitudinal direction of the well, at least one zone of the actuator containing a fluid that is at substantially the same pressure as the bottom of the well, said device further comprising at least one sealing bellows interposed in said direction between the casing and the moving member, the sealing bellows defining at least a portion of said zone.

BRIEF DESCRIPTION OF THE DRAWINGS

Various embodiments of the invention are described below as non-limiting examples and with reference to the accompanying drawings, in which.

DETAILED DESCRIPTION OF EMBODIMENSTS OF THE INVENTION

Figure 1:
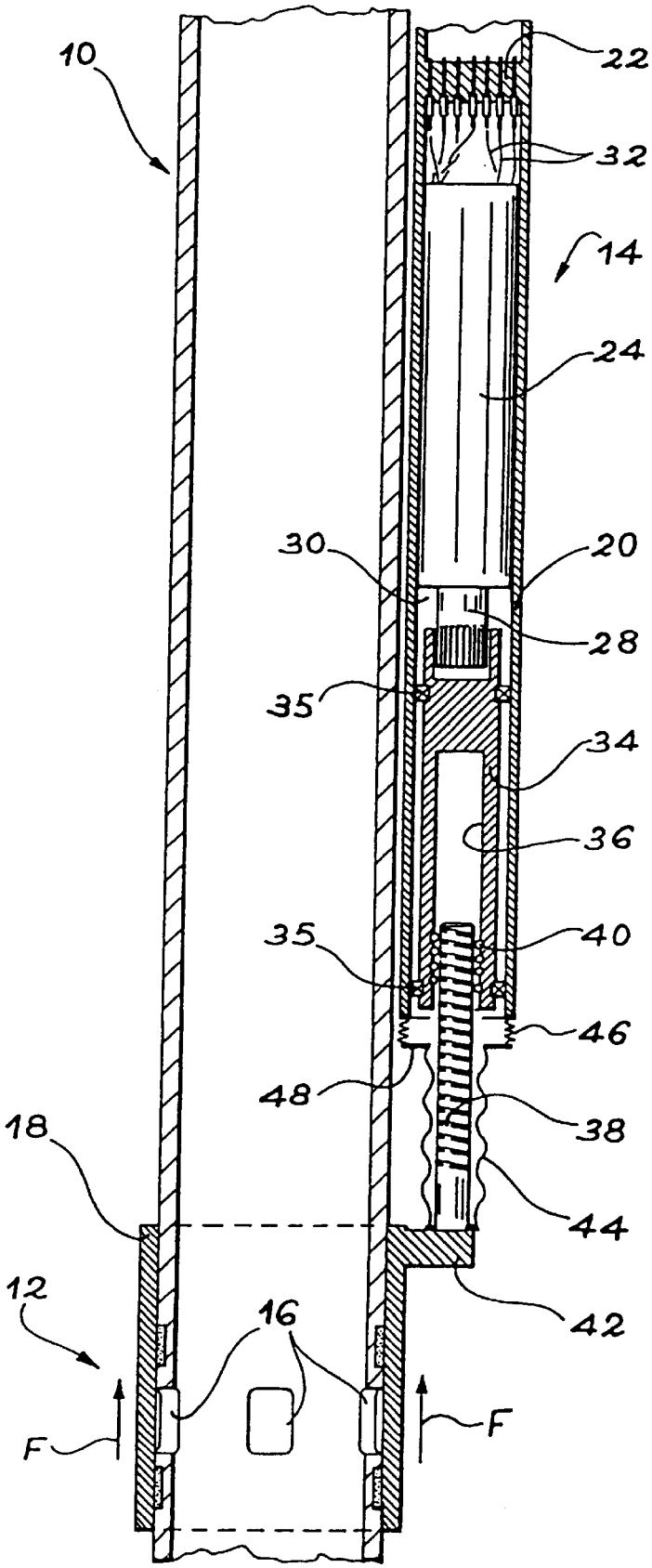
FIG. 1 is a longitudinal section view of an electromechanical type of downhole actuator fitted with two sealing bellows mounted end-to-end in a first embodiment of the invention.

In FIG. 1, reference 10 designates a length of production tubing mounted at the bottom of an oil or gas well (not shown). An adjustable flow rate valve 12 under the control of an actuator 14 is mounted on this length of tubing 10. More precisely, the actuator 14 is designed to remain downhole for a very long period of time without maintenance, e.g. about 5 years.

The variable flow rate valve 12 has at least one opening 16 made through the length of production tubing 10, together with a jacket 18 suitable for sliding on said length 10 parallel to its axis. The sliding of the jacket 18 on the length of production tubing 10, as represented by arrows F in FIG. 1, is controlled in continuous manner by the actuator 14. It makes it possible in controlled manner to uncover the openings 16 in full or in part.

In the first embodiment of the invention as shown in FIG. 1, the actuator 14 is an electromechanical actuator. This actuator comprises a tubular casing 20 in which control means are housed. In the example shown, the casing 20 is fixed to one side of the length of production tubing 10, parallel to its axis. The casing 20 has an open bottom end facing towards the jacket 16 and its top end is closed by a leakproof partition 22.

An electronics module (not shown) generally situated above the actuator 14 and at atmospheric pressure, serves to feed electricity thereto via electrical conductors 32 which pass through the partition 22 in sealed manner.

Going from the leakproof partition 22, the drive means comprise in this case a motor and gear box unit 24 and an outlet shaft 28 which projects into a chamber 30 filled with hydraulic fluid. When the motor unit 24 is powered, it rotates the outlet shaft 28 at a slow and controlled speed.

A nut-forming intermediate member 34 is rotatably mounted inside the chamber to rotate about the axis of the casing 20, e.g. on bearings 35. The top end of the intermediate member 34 engages the outlet shaft 28. The intermediate member also has a downwardly open bore 36 extending over a major fraction of its height. At its bottom end, the bore 36 is tapped so as to engage a moving member 38 that is in the form of a threaded rod via a screw-and-nut type link 40, e.g. with circulating balls. The moving member 38 is likewise centered on the axis of the casing 20. Its bottom end is fixed to a lug 42 projecting from the jacket 18.

In the above-described organization, rotation of the outlet shaft 28 caused by powering the motor and gear box unit 24 gives rise to identical rotation of the intermediate member 34 inside the chamber 30. Because the moving member 38 is secured to the jacket 18, it is prevented from rotating about its own axis. Consequently, the rotation of the intermediate member 34 gives rise to translation of the moving member 38 along the axis of the casing 20, i.e. parallel to the axis of the length of production tubing 10. The jacket 18 is thus caused to move in the direction corresponding to the arrow F.

According to the invention, sealing between the bottom of the well and the zone inside the casing 20 that is constituted by the chamber 30 that is full of hydraulic fluid is provided by a first metal sealing bellows 44 of relatively small diameter.

In addition, both compensation for the changes in the volume of the chamber 30 due to the displacement of the moving member 38 along its axis, and also compensation for variations in pressure and temperature downhole is advantageously provided by a metal compensation bellows 46 of relatively large diameter. In other words, the compensation bellows 46 serves to maintain the pressure in the fluid contained inside the chamber 30 equal to the pressure of the downhole fluid.

In the embodiment shown in FIG. 1, the sealing bellows 44 and the compensation bellows 46, both of which are leakproof, are mounted end-to-end on a common axis between the bottom end of the moving member 38 and the open bottom end of the casing 20.

More precisely, the top end of the compensation bellows 46 is fixed in sealed manner directly to the open bottom end of the casing 20. The bottom end of the compensation bellows 46 is terminated in a radial wall 48 extending perpendicularly to the axis of the bellows and in which a circular central opening is formed. The top end of the sealing bellows 44 is fixed in sealed manner to the rim of the central opening in the above-mentioned wall 48 and the bottom end of the sealing bellows 44 is fixed in sealed manner to the bottom end of the moving member 38 (or to the lug 42).

In practice, the bellows 44 and 46 are preferably made of stainless steel. They can be made, in particular, by hydroforming, by electrodeposition, or in the form of welded together waves.

The behavior of the bellows 44 and 46 is described in greater detail below with reference to FIG. 2.

In this figure, (a) represents the states of the bellows 44 and 46 when the valve 12 is fully closed, and (b) and (c) show the states of the same bellows when the valve 12 is fully open.

Between the situation in which the valve 12 is fully closed as shown in (a) and the situation in which the valve is fully open, as shown in (b) and (c), the bottom end of the sealing bellows 44 fixed to the bottom end of the moving member 38 moves upwards through a distance d1 equal to the stroke of the jacket 18. Simultaneously, the radial wall 48 moves in the opposite direction, i.e. downwards, through a distance d2. This displacement corresponds to the compensation bellows 46 expanding as made necessary to take account of the reduction in the volume of the chamber 30 due to the moving member 38 moving into it.

Figure 2:
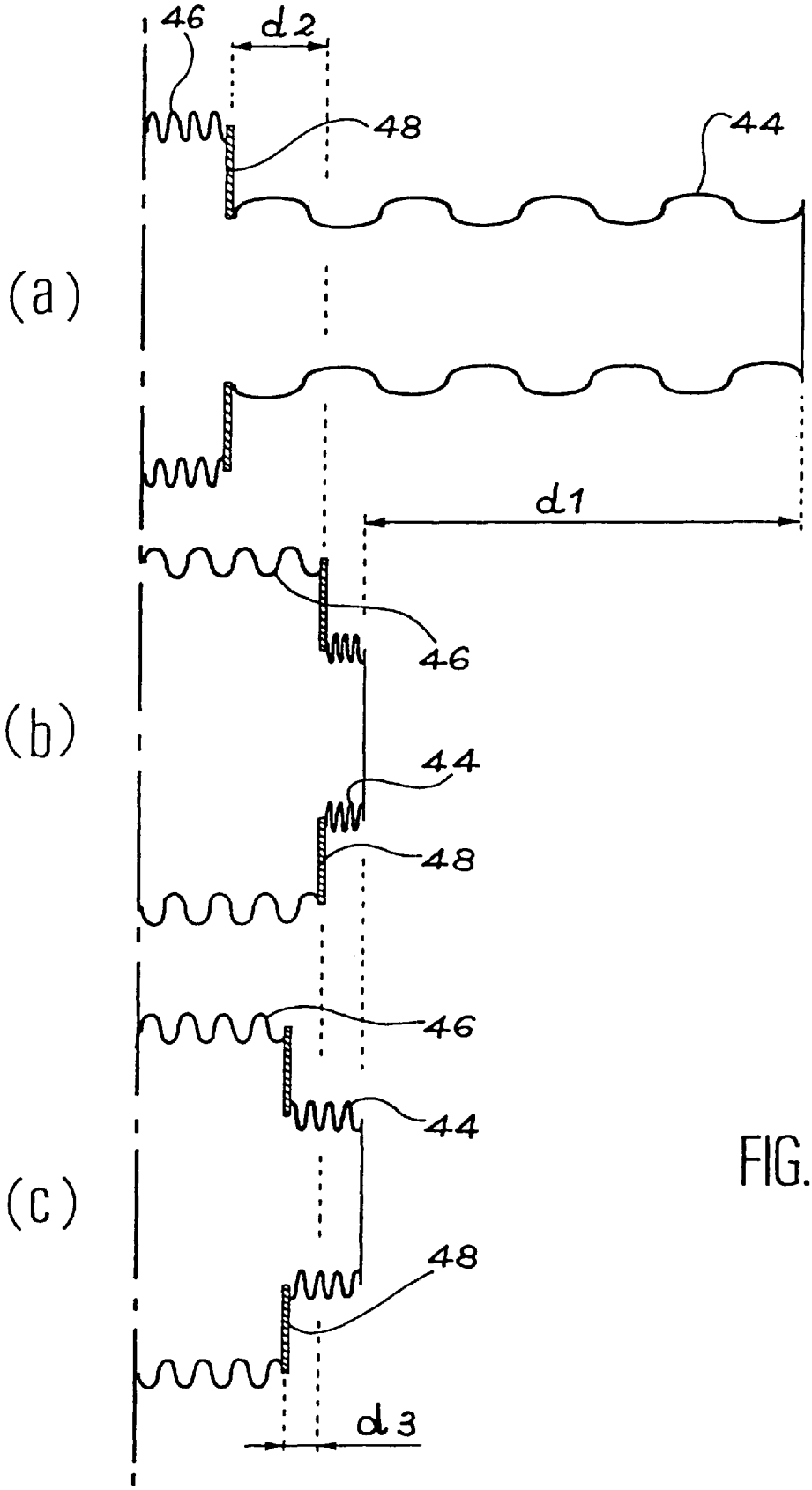
FIG. 2 shows the two bellows used in the FIG. 1 actuator on a larger scale and in three different operating states (a), (b), and (c)

View (c) in FIG. 2 shows that the radial wall 48 can also move independently of any operation of the actuator, e.g. through a distance d3. This type of displacement corresponds to compensating for any variation of pressure or temperature in the well, and is likewise performed by the compensation bellows 46 given the difference in diameter between the two bellows. This type of compensation as illustrated for the situation in which the valve is opened, takes place whatever the position of the valve.

A variant of the first embodiment of the invention is described below with reference to FIG. 3.

This variant differs from the embodiment described above essentially by the fact that instead of being mounted end-to-end, the sealing bellows 44 and the compensation bellows 46 are completely dissociated.

More precisely, the bottom end of the sealing bellows 44 remains fixed to the bottom of the moving member 38 (or to the lug 42), but its top end is fixed directly and in sealed manner to the open bottom end of the tubular casing 20.

The radial wall 48 of the compensation bellows 46 has no opening and the top end of this bellows is fixed in sealed manner to the lug 42 in line with the moving member 38. The volume defined inside the compensation bellows 46 is then connected to the chamber 30 via a passage 50 running along the entire length of the moving member 38 and passing through the lug 42.

In another variant (not shown), the compensation bellows 46 can be mounted above the leakproof partition 22. The inside volume of the bellows 46 is then connected to the chamber 30 via a passage passing along the top portion of the casing 20.

Figure 3:
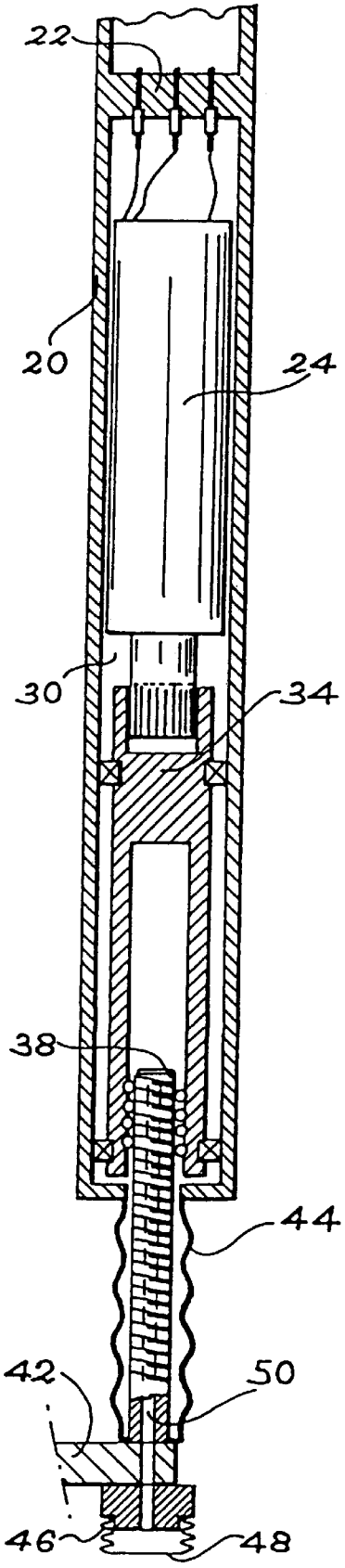
FIG. 3 is a longitudinal section view comparable to FIG. 1 and showing a variant of the first embodiment of the invention.
Figure 4:
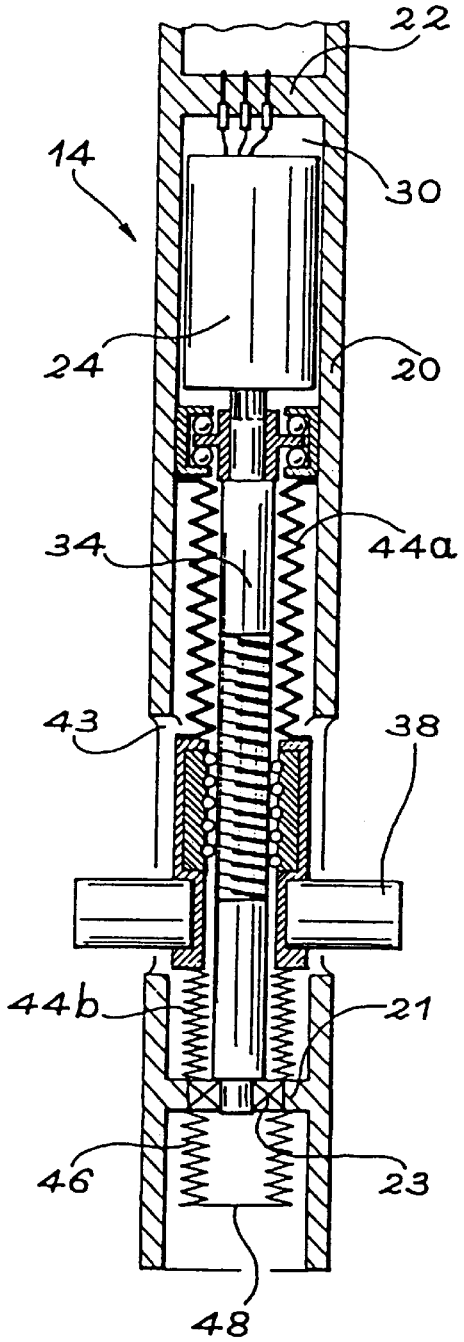
FIG. 4 is a view comparable to FIG. 3, showing another variant of the first embodiment of the invention.

Another variant of the first embodiment of the invention, shown in FIG. 4, differs from the variant of FIG. 3 mainly by the fact that instead of being placed beyond the bottom end of the casing 20, the moving member 38 is situated between the top and bottom ends of the casing.

In this case, the moving member 38 passes through an oblong opening 43 made through the casing 20. This opening enables the member 38 to move along the longitudinal axis of the well, under control of the actuator 14.

This organization requires two sealing bellows 44*a* and 44*b* to be used which are disposed respectively above and below the moving member 38. More precisely, the sealing bellows 44*a* connects the top end of the nut constituting the member 38 in this case to a portion of the casing 20 that is situated immediately below the motor and gear box unit 24. The sealing bellows 44*b* also connects the bottom end of the nut forming the member 38 to a bottom partition 21 of the casing 20.

With this organization, the volume of the zone 30 that is filled with hydraulic fluid remains practically unvarying. This zone is defined between the casing 20 and the motor and gear box unit 24 and between the threaded rod (forming the intermediate member 34) and each of the bellows 44*a* and 44*b*.

Under such circumstances, the end of the compensation bellows 46 remote from its radial wall 48 can be fixed directly to the bottom face of the partition 21 as shown in FIG. 4. The bellows 46 then communicates with the zone 30 via the ball bearing 23 used for supporting the bottom end of the threaded rod 34 in the partition 21.

In a variant, the compensation bellows 46 can also be mounted on top of the leakproof partition 22, as described above.

In the above-described embodiment, and with reference to FIG. 1, and also in the variants mentioned, it should be observed that instead of being mounted in a tubular casing 20 that is fixed to the outside of a length of production tubing 10, the control means (including in this case the motor and gear box unit 24) can be disposed in an annular space formed between the length of tubing 10 and a tubular casing mounted coaxially around said length. Under such circumstances, the moving member 38 can also be a tubular member surrounding the length of tubing 10 coaxially.

A second embodiment of the invention is described below with reference to FIG. 5.

This second embodiment relates to a downhole actuator 114 of the hydraulic type. As before, the example shown is applied to controlling an adjustable flow rate valve 112.

Figure 5:
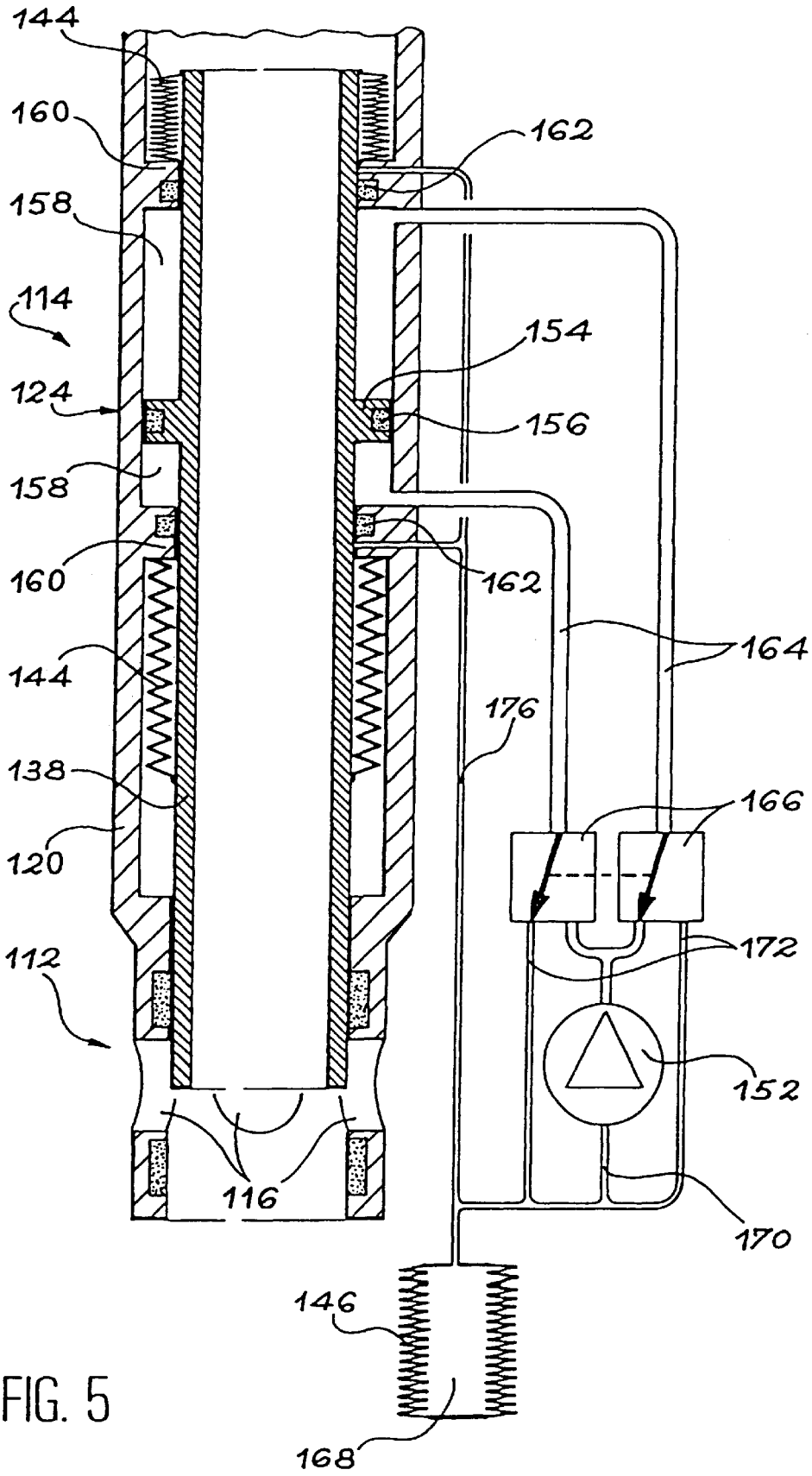
FIG. 5 is a longitudinal section view of a hydraulic type downhole actuator, illustrating a second embodiment of the invention.

In the embodiment of FIG. 5, the control means comprise a hydraulic actuator 124 suitable for being actuated by a pump 152 or by any other pressure source.

More precisely, the hydraulic actuator 124 includes a cylindrical casing 120 together with a piston 154. The piston 154 is secured to a tubular moving member 138 that is slidably mounted coaxially inside the cylindrical casing 120. The piston 154 cooperates with the inside surface of the cylindrical casing 120 via a first sealing gasket 156. On either side of the piston 154, the annular spaces formed between the cylindrical casing 120 and the tubular moving member 138 constitute control chambers 158 of the actuator 124. Each of the control chambers 158 is defined remote from the piston 154 by a partition 160 that constitutes an integral portion of the cylindrical casing 120. The control chambers 158 are sealed by annular sealing gaskets 162 mounted in grooves formed in the partitions 160 so as to be in sealing contact with the cylindrical outer surface of the tubular moving member 138.

Two pipes 164 opening out respectively into each of the control chambers 158 of the actuator are connected in turn to the delivery orifice of the pump 152 via two distributor valves 166. The intake orifice of the pump 152 is connected to an external supply of fluid 168 via a pipe 170. The outlets from the distributor valves 166 that are not in communication with the delivery orifice of the pump 152 are also connected to the external supply of fluid 168 by pipes 172.

In the embodiment shown in FIG. 5, the valve 112 is implemented in the form of an opening 116 formed in a downward extension of the cylindrical casing 120 and by a jacket-forming bottom portion of the tubular moving member 138. This bottom portion is suitable for covering the openings 116 in full or in part, or for uncovering them completely, depending on the position of the piston 154 inside the cylindrical casing 120.

According to the invention, a metal sealing bellows 144 is interposed between the tubular moving member 138 and each of the partitions 160, on the sides thereof remote from the control chambers 158.

More precisely, a first end of each sealing bellows 144 is fixed in sealed manner to the corresponding partition 160 and a second end of the same bellows is fixed in sealed manner to the tubular moving member 138. The inside volume of each of the sealing bellows 144 thus communicates with one of the control chambers 158 via a corresponding sealing gasket 162. The inside volume of the bellows is also connected to the external fluid supply 168 via a pipe 176. In this way, the hydraulic fluid contained inside each of the sealing bellows 144 is at the same pressure as the well fluid.

By means of the above-described organization, even if the gaskets 162 leak, the sealing bellows 144 prevent any well fluid from penetrating into the inside of the actuator 114. In addition, the dynamic sealing gaskets no longer run the risk of coming into contact with sand or other corrosive matter and all loss of oil is prevented. The actuator 114 can thus be used without maintenance for a long period of time, e.g. several years.

According to another aspect of the invention, the external fluid supply 168 is defined at least in part by a compensation bellows 146 as shown diagrammatically in FIG. 5.

In general, it should be observed that if the embodiments and variants described relate solely to controlling valves, the actuator of the invention can be used downhole to control any other moving member without going beyond the ambit of the invention.

In addition, the moving member controlled by the actuator need not be directly attached to the part whose displacement is to be controlled. Thus, and purely by way of example, a motion-transforming mechanism can be interposed between the moving member of the actuator and a rotary part, thereby enabling the actuator of the invention to be used for controlling a rotary valve.

We claim:

1. An actuator for downhole tools, comprising:

a housing;

a moving member;

a drive mechanism that moves the moving member in a longitudinal direction relative to the housing;

at least one zone defined in the housing containing a fluid at a pressure substantially equal to the pressure down the well;

at least one sealing bellows between the housing and the moving member; and the sealing bellows defining at least a portion of the zone.

2. An actuator as in claim 1, wherein the sealing bellows is made of stainless steel.

3. An actuator as in claim 1, further comprising a compensation bellows connected to the zone, the compensation bellows including a radial wall subjected to the pressure down the well.

4. An actuator as in claim 3, wherein the compensation bellows is made of stainless steel.

5. An actuator as in claim 3, wherein:

the sealing bellows and the compensation bellows are mounted in end-to-end alignment;

a radial wall of the compensation bellows has a central opening with a rim defined therein;

one end of the compensation bellows is fixed to the housing; and the sealing bellows connects the moving member to the rim.

6. An actuator as in claim 3, wherein:

the sealing bellows connects the moving member to the housing; and the compensation bellows communicates separately with the zone.

7. An actuator as in claim 6, wherein:

the moving member is placed at least partially beyond one end of the housing; and the sealing bellows connects the moving member to the housing end.

8. An actuator as in claim 6, wherein:

the housing includes an opening;

the moving member is located at least partially facing the housing opening; and two sealing bellows connect the moving member to the housing on respective sides of the housing opening.

9. An actuator as in claim 7, wherein:

the end of the compensation bellows opposite the radial wall is functionally attached to a portion of the moving member situated outside the housing; and the moving member includes a duct therethrough that provides fluid communication between the zone and the compensation bellows.

10. An actuator as in claims 7 or 8, wherein the end of the compensation bellows opposite the radial wall is fixed to an end of the housing and communicates with the zone.

11. An actuator as in claim 3, wherein the sealing bellows and the compensation bellows are made of stainless steel.

12. An actuator as in claim 1, wherein the drive mechanism comprises:

an electric motor housed in the housing;

an intermediate member rotatably mounted in the housing and engaged on the moving member by a screw-and-nut type coupling; and the intermediate member adapted to be rotated by the electric motor.

13. An actuator as in claim 1, wherein the housing is fixed to one side of a segment of production tubing and is parallel thereto.

14. An actuator as in claim 1, wherein the housing surrounds a segment of production tubing coaxially.

15. An actuator as in claim 1, wherein:

the drive mechanism comprises a hydraulic actuator actuated by a pressure source, the hydraulic actuator including a piston;

the piston is adapted to slide in a fluid-tight manner in the housing and defines at least one pressure chamber connected to the pressure source;

the moving member is secured to the piston; and the zone is formed outside the chamber, is separated therefrom by at least one sealing gasket, and is connected to a fluid tank defined at least in part by compensation bellows.

16. A device for adjusting downhole flow rate, comprising:

a segment of production tubing including at least one opening therein;

a sleeve slidably mounted on the segment;

a moving member secured to the sleeve;

an actuator including a housing and a drive mechanism;

the housing being secured to the segment, and the drive mechanism moving the moving member relative to the housing in a longitudinal direction of a well;

at least one zone defined in the housing containing a fluid at a pressure substantially equal to the pressure down the well;

at least one sealing bellows between the housing and the moving member; and the sealing bellows defining at least a portion of the zone.

17. A device for actuating moving parts disposed in a wellbore, comprising:

a segment of production tubing;

a moving part mounted on the segment;

a moving member secured to the moving part;

an actuator including a housing and a drive mechanism, wherein the housing is secured to the segment and the drive mechanism moves the moving member relative to the housing in a longitudinal direction of the wellbore;

at least one zone defined in the housing containing a fluid at a pressure substantially equal to the pressure down the well;

at least one sealing bellows between the housing and the moving member; and the sealing bellows defining at least a portion of the zone.

18. A device for actuating moving parts disposed in a wellbore, comprising:

a segment of production tubing;

a moving part mounted on the segment;

an actuator for actuating the movement of the moving part; and at least one sealing bellows attached to the actuator for sealing the actuator from the downhole environment; and a compensating bellows functionally attached to the actuator for maintaining a fluid contained in the actuator at substantially the same pressure as that of downhole fluid in the wellbore.

19. An actuator for downhole tools, comprising:

a housing;

at least one sealing bellows attached to the housing for sealing the housing from the downhole environment; and a compensating bellows functionally attached to the housing for maintaining a fluid contained in the housing at substantially the same pressure as that of downhole fluid.

20. A method for actuating a downhole tool, comprising:

providing an actuator including a housing, a moving member, at least one sealing bellows, and a drive mechanism that moves the moving member in a longitudinal direction relative to the housing, the housing and the sealing bellows at least partially defining at least one zone that contains fluid at a pressure substantially equal to the pressure down the well; and sealing the zone from the downhole environment by use of the sealing bellows.

21. A method for actuating a downhole tool, comprising:

providing an actuator including a housing, a moving member, at least one sealing bellows, and a drive mechanism that moves the moving member in a longitudinal direction relative to the housing, the housing and the sealing bellows at least partially defining at least one zone that contains fluid at a pressure substantially equal to the pressure down the well;

sealing the zone from the downhole environment by use of the sealing bellows; and maintaining the fluid contained in the zone and the downhole fluid at substantially the same pressure by use of a compensating bellows functionally attached to the housing.

22. A method for actuating moving parts disposed in a wellbore, comprising:

providing an actuator including a housing and a moving member, the housing secured to a segment of production tubing and the moving member secured to the moving part;

moving the moving member thereby also moving the moving part; and sealing the housing from the downhole environment by use of a sealing bellows.

23. A method as in claim 22, further comprising using a compensating bellows functionally attached to the housing to maintain the housing and a downhole fluid at substantially the same pressure.

24. An actuator for downhole tools, comprising:

a housing;

a moving member;

a drive means for moving the moving member in a longitudinal direction relative to the housing;

at least one zone defined in the housing containing a fluid at a pressure substantially equal to the pressure down the well;

at least one sealing bellows between the housing and the moving member; and the sealing bellows defining at least a portion of the zone.

25. A device for adjusting downhole flow rate in a well, comprising:

a segment of production tubing including at least one opening therein;

a sleeve slidably mounted on the segment;

a moving member secured to the sleeve;

an actuator including a housing and a drive means, wherein the housing is secured to the segment and the drive means moves the moving member relative to the housing in a longitudinal direction of the well;

at least one zone defined in the housing containing a fluid at a pressure substantially equal to a downhole fluid pressure-in the well;

at least one sealing bellows between the housing and the moving member; and the sealing bellows defining at least a portion of the zone.

* * * * *